United States Patent [19]

Collins

[11] Patent Number: 4,724,926

[45] Date of Patent: Feb. 16, 1988

[54] OIL DISPENSER FOR INTERNAL COMBUSTION ENGINES

[76] Inventor: Lonnie L. Collins, 10339 Electric Blvd., Northfield, Ohio 44067

[21] Appl. No.: 875,951

[22] Filed: Jun. 19, 1986

[51] Int. Cl.[4] ..... F01M 11/12; F16K 31/02; F16K 51/00

[52] U.S. Cl. ..... 184/1.5; 184/103.1; 123/196 S; 251/144; 251/129.15

[58] Field of Search ..... 184/103.1, 1.5; 123/196 S, 196 R; 251/144, 129.15, 129.17; 137/624.11, 624.18

[56] References Cited

U.S. PATENT DOCUMENTS

| | | | |
|---|---|---|---|
| 1,251,606 | 1/1918 | Williamson | 184/103.1 |
| 1,256,020 | 2/1918 | Hove | 184/18 |
| 1,352,954 | 9/1920 | Hansen | 123/196 R |
| 1,465,167 | 8/1923 | Miller | 184/103.1 |
| 1,498,362 | 6/1924 | Dowd | 184/103.1 |
| 1,548,222 | 8/1925 | Spreen | 184/103.1 |
| 1,587,922 | 6/1926 | Rosson | 184/13.1 |
| 1,972,962 | 9/1934 | Weber | 137/454 |
| 2,671,529 | 3/1954 | Hungerford | 184/103.2 |
| 2,792,912 | 5/1957 | Kangas | 123/196 S |
| 2,946,328 | 7/1960 | Mett et al. | 123/196 R |
| 3,297,011 | 1/1967 | Gray | 123/196 R |
| 3,429,402 | 2/1969 | Hasenbank | 184/103.1 |
| 3,447,636 | 6/1969 | Bonfilio | 123/196 R |
| 3,500,962 | 3/1970 | Kocher | 184/103.1 |
| 3,712,420 | 1/1973 | Pelizonni | 184/103.1 |
| 3,876,037 | 4/1975 | Rath | 184/6.4 |
| 4,091,894 | 5/1978 | Lang | 184/103.1 |
| 4,091,895 | 5/1978 | Lang | 184/103.1 |
| 4,108,201 | 8/1978 | Lang | 184/103.1 |
| 4,262,877 | 4/1981 | Lang | 251/129.15 |
| 4,299,307 | 11/1981 | Scott | 184/103.1 |
| 4,442,997 | 4/1984 | Idogaki | 251/129.15 |
| 4,480,718 | 11/1984 | Marinelli | 184/103.1 |
| 4,491,103 | 1/1985 | Deadman | 123/196 S |
| 4,632,080 | 12/1986 | Hurner | 123/196 S |

*Primary Examiner*—Carlton R. Croyle
*Assistant Examiner*—Jane E. Obee
*Attorney, Agent, or Firm*—Wayne D. Porter, Jr.

[57] ABSTRACT

An oil dispenser for internal combustion engines having a crankcase includes an oil-containing, airtight reservoir disposed at a vertical location above the crankcase. A conduit connects the reservoir and the crankcase in order to establish fluid communication between the reservoir and the crankcase. The conduit has a lower end disposed in the crankcase at a level at which oil is desired to be maintained in the crankcase. A solenoid-activated valve is disposed at the lower end of the conduit to selectively permit or prevent the flow of oil through the conduit. The solenoid-activated valve includes a cup-like member which surrounds and is fitted against the lower end of the conduit upon valve closure. A control means is connected to the solenoid-activated valve for opening the solenoid-activated valve only after the engine has ceased operation and after a predetermined period of time has elapsed.

11 Claims, 4 Drawing Figures

OIL DISPENSER FOR INTERNAL COMBUSTION ENGINES

BACKGROUND OF THE INVENTION

1. Field of the Invention

The invention relates to techniques for maintaining a desired level of oil in crankcases and sumps and, more particularly, to an oil dispenser especially adapted for use with internal combustion engines.

2. Description of the Prior Art

In internal combustion engines, lubricating oil typically is stored in a crankcase or sump disposed on the underside of the engine. During the operation of the engine, oil is withdrawn from the crankcase and is pumped throughout the engine in order to cool, lubricate, and clean various moving parts. Oil thus circulated eventually is returned to the crankcase. Depending upon the age of the engine, its manner of operation, and other factors, oil eventually is consumed and the level of oil in the crankcase drops. The characteristic of internal combustion engines to consume lubricating oil requires that the operators of such engines check the level of oil in the crankcase at relatively frequent intervals.

Even if the oil level is checked regularly and oil is replenished when necessary, it is possible that too much or too little oil will be added. It is well known that internal combustion engines have an optimum oil level—if the oil level deviates from the optimum level then the rate of oil consumption increases. Accordingly, it is desirable not only to maintain a minimum quantity of oil in the crankcase under all operating conditions in order to prevent engine damage, but the quantity of oil in the crankcase should be maintained as close as possible to the optimum level for that engine. Unfortunately, the conventional technique of manually checking the oil level and replenishing oil as necessary is an ineffective way to maintain an optimum level of oil in the crankcase.

In order to address the foregoing concerns, various oil dispensers have been created for use with internal combustion engines. In general, these devices dispense oil to a crankcase or sump from an airtight container by means of gravity. Certain devices employ a single tube that provides both an oil flow and an oil level control function. Other devices employ two tubes, one for dispensing oil and one for controlling the flow of oil to be dispensed. Most oil dispensers include a control valve of some type, either manual or automatic, that permits the dispensing of oil either when the engine has been shut down or while it is operating. Representative dispensers of the type described are shown by U.S. Pat. Nos. 1,251,606, 2,671,529, 1,465,167, and others.

Although oil dispensers for internal combustion engines have been known for many years, they have not been utilized to any significant extent. One of the reasons for the lack of utilization of such devices is believed to be their expense. Particularly in the case of oil dispensers adapted for use with engines during operation, fairly sophisticated level-control apparatus is required to insure that the engine is not over-lubricated or under-lubricated. Even in less complex and expensive devices adapted to dispense oil only while the engine is inoperatively, considerations of expense and complexity have limited the utilization of such devices.

SUMMARY OF THE INVENTION

In response to the foregoing considerations, the present invention provides a new and improved oil dispenser for internal combustion engines wherein the device can be manufactured at modest expense while providing ease of operation and great reliability. The oil dispenser according to the invention includes an oil-containing airtight reservoir disposed at a vertical location above the engine crankcase. A conduit connects the reservoir in the crankcase so as to establish fluid communication between the reservoir and the crankcase. The conduit has a lower end disposed in the crankcase at a level at which oil is desired to be maintained.

A solenoid-activated valve is disposed at the lower end of the conduit, the valve adapted to selectively permit or prevent the flow of oil through the conduit. A control means is connected to the solenoid-activated valve and permits the solenoid-activated valve to be opened only after the engine has ceased operation and after a predetermined period of time has elapsed.

In an especially preferred embodiment of the invention, the crankcase includes a hollow protrusion extending outwardly of the crankcase and in fluid communication therewith. The protrusion is located at a vertical location at which oil is desired to be maintained in the crankcase. The protrusion includes a first opening through which the conduit extends such that the lower end of the conduit terminates at a vertical location within the protrusion. The protrusion also includes a second opening through which a shaft extends from the solenoid of the solenoid-activated valve. A cup-like member is disposed within the protrusion and surrounds and is fitted against the lower end of the conduit upon valve closure. If desired, an elastomeric valve seat can be disposed at the bottom of the cup-like member.

The oil dispenser according to the invention also can be provided with a second solenoid-activated valve disposed in the conduit, which valve includes a manually operated switch to control operation of the valve. The second valve can be used to facilitate replenishing oil in the reservoir. The foregoing and other features and advantages of the invention will become apparent from the accompanying specification, drawings, and claims.

DESCRIPTION OF THE PREFERRED EMBODIMENT

Figure 1:
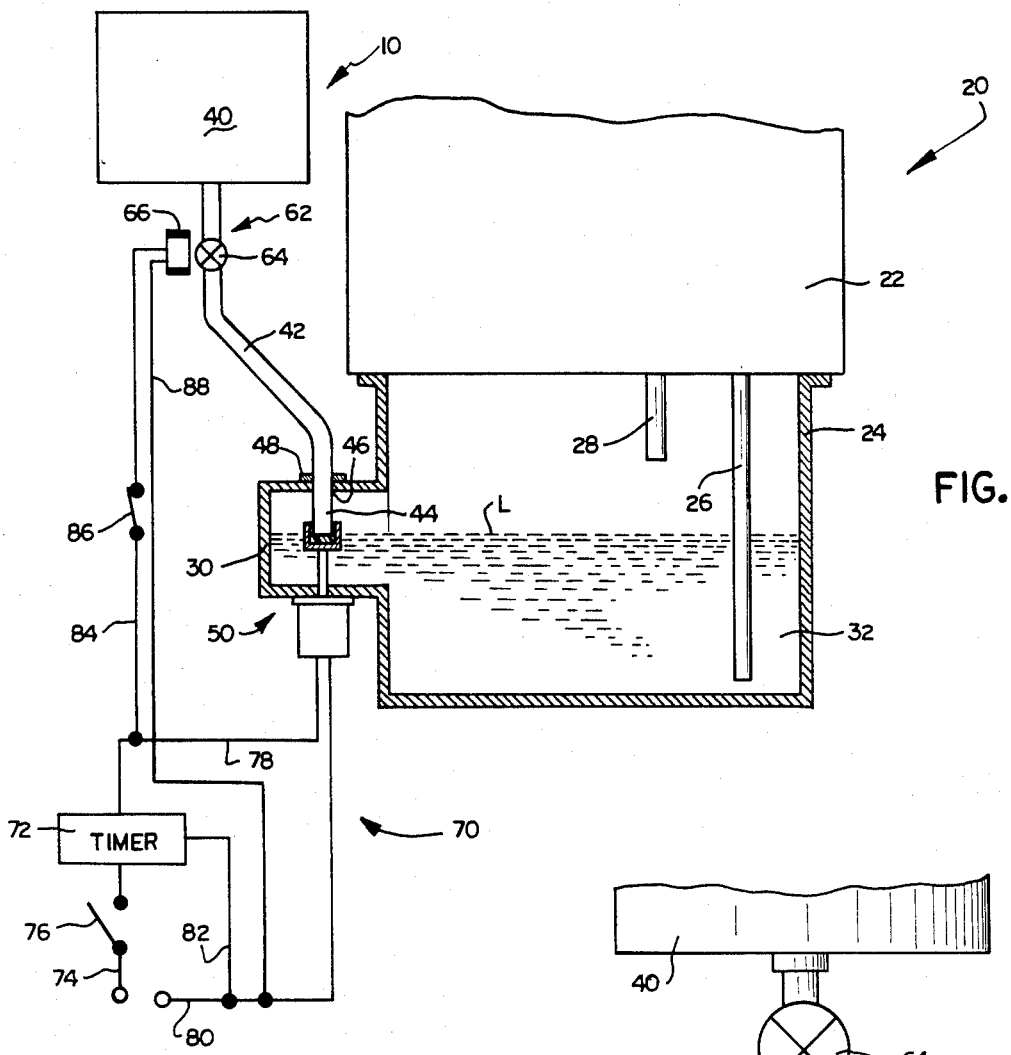
FIG. 1 is a schematic representation of an oil dispenser according to the invention used in conjunction with an internal combustion engine having a crankcase.

Referring to FIGS. 1–4, an oil dispenser 10 according to the invention is adapted for use with an internal combustion engine indicated generally by the reference numeral 20. The engine 20 includes an engine block 22 to which a crankcase 24 is attached on its underside. The engine 20 includes a conduit 26 through which lubricating oil is pumped throughout the engine 20 and a return line 28 through which circulated oil is returned to the crankcase 24. The crankcase 24 includes an outwardly extending protrusion 30. The crankcase is adapted to hold a quantity of lubricating oil 32 having an optimum level L. The protrusion 30 is disposed at a vertical location which brackets the optimum level L. Although the protrusion 30 is illustrated as being an integral part of the crankcase 24, it is expected that existing crankcases 24 can be retrofitted with protrusions 30 by drilling an appropriate opening or openings in the crankcases 24 and attaching the protrusions 30 to the side of the crankcases 24 by means of appropriate flanges, gaskets, and fasteners.

The oil dispenser 10 includes a reservoir 40 disposed at a vertical location above the crankcase 24. It is expected that the reservoir 40 will be manufactured from a plastics material in a molding operation of some type. The reservoir 40 includes a cover (not shown) through which oil can be added to the reservoir 40 and which, upon closure, renders the reservoir 40 substantially airtight. It is expected that the reservoir 40 will be fastened to the fire wall, the fender well, or any other convenient location close to the engine 20. Techniques for fastening containers such as the reservoir 40 to vehicle components such as fire walls and fender wells are well known and do not require further description here.

A conduit 42 extends from the underside of the reservoir 40 and is oriented generally vertically. The conduit 42 includes a lower end 44 extending through an opening 46 in the protrusion 30. The conduit 42 establishes fluid communication between the reservoir 40 and the crankcase 24. The lower end 44 is disposed within the protrusion 30 at a position where it is desired to establish the level L. The lower end 44 is maintained in this position and is sealed within the opening 46 by means of a ferrule 48.

A normally closed, solenoid-activated valve 50 is disposed at the lower end of the conduit 42 in order to selectively permit or prevent the flow of oil through the conduit 42. The valve 50 includes a cup-like member 52 adapted to surround and to be fitted against the lower end 44. An elastomeric valve seat 54 is disposed at the bottom of the cup-like member 52 in order to provide a more positive sealing action. The valve 50 includes a solenoid 56 secured to the underside of the protrusion 30. A shaft 58 extends through an opening 60 in the protrusion 30 and connects the cup-like member 52 and the solenoid 56.

A second, normally open, solenoid-activated valve 62 is carried by the conduit 42 in order to provide an additional control over oil flowing through the conduit 42. The valve 62 includes a valve element 64 disposed within the conduit 42 and a solenoid 66 disposed outside the conduit 42 but operatively connected to the valve element 64.

A control means 70 is provided to control the dispensing of oil into the crankcase 24. The control means 70 includes a controllable timer 72 connected to the positive side of a 12 volt DC source by means of a lead line 74 and a switch 76. It is expected that the switch 76 normally will be part of the ignition switch of a vehicle. The timer 72 is connected to the solenoid 56 by means of a lead line 78. A lead line 80 connects the other side of the solenoid 56 to a negative ground. A lead line 82 connects the timer 72 to the lead line 80 for purposes of establishing a ground for the timer 72. A lead line 84 is connected between the lead line 78 and the solenoid 66. A manually operated switch 86 is disposed in the lead line 84 in order to control operation of the solenoid 66. A lead line 88 connects the other end of the solenoid 66 to the lead line 80 in order to ground the solenoid 66.

OPERATION

Figure 2:
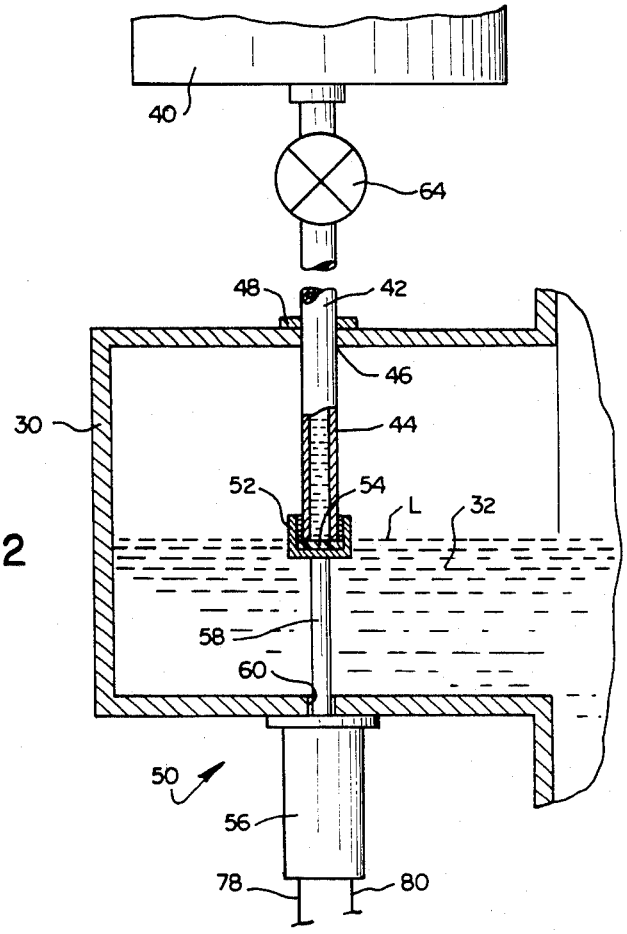
FIG. 2 is an enlarged view of portions of FIG. 1.
Figure 3:
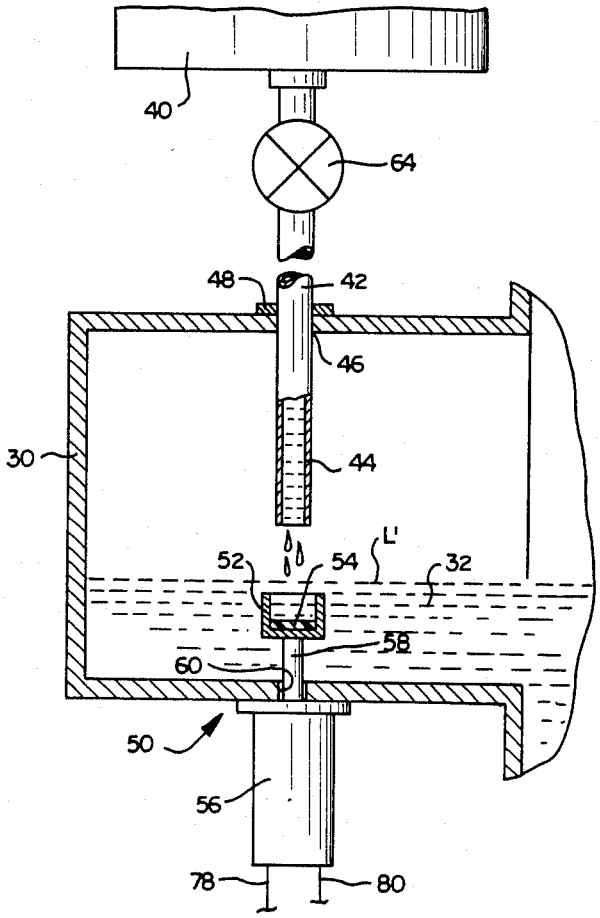
FIG. 3 is a view similar to FIG. 2 showing the oil dispenser according to the invention in the process of additing oil to the crankcase.

Referring particularly to FIG. 2, the oil dispenser 10 is shown as it appears immediately upon engine start-up. The oil 32 is at the desired level L and the solenoid-activated valve 50 seals the lower end 44 in order to prevent any flow of oil through the conduit 42. Referring also to FIG. 1, the switch 76 is open while the engine is running, thereby disabling the timer 72. The normally closed solenoid 56 is biased to the valve-closed position shown in FIGS. 1 and 2 by means of an interally disposed spring (not shown). Accordingly, as long as the engine 20 is running, the switch 76 will be open, the valve 50 will be closed, and additional oil cannot be added to the crankcase 24.

After engine start-up, the level L will fall within the crankcase 24 due to oil 32 being circulated throughout the engine 20 by way of the lines 26, 28. Although a stabilized, lower oil level eventually will be attained, it would be undesirable to use the lower, stabilized level as the optimum level for the oil 32 due to various factors such as foaming which may occur in the oil (particularly detergent oil), oil level changes which may arise from unusual vehicle attitudes that may be attained during operation (during acceleration, deceleration, hard cornering or driving up and down hills), and other factors. Hence, the dispenser 10 is constructed and operated such that oil cannot be added to the crankcase 24 while the engine 20 is being operated.

Upon engine shutdown, the switch 76 will be closed, thereby activating the timer 72. Although the timer 72 can be set to remain disabled for various intervals after closure of the switch 76, it is expected that the timer 72 will remain disabled for at least one minute after closure of the switch 76. The particular period selected should be such as to enable most of the oil 32 to drain into the crankcase 24 and for most foaming to subside. After the predetermined period of time has elapsed, the timer 72 causes the solenoid 56 to be activated, thereby moving the cup-like member 52 to that position shown in FIG. 3. The lowered level L' of the oil 32 is indicative of oil 32 that was consumed during engine operation. In the position of the components illustrated in FIG. 3, and if the switch 86 has been moved to the open position, oil will be dispensed under the influence of gravity from the reservoir 40 through the conduit 42 and into the crankcase 24.

Figure 4:
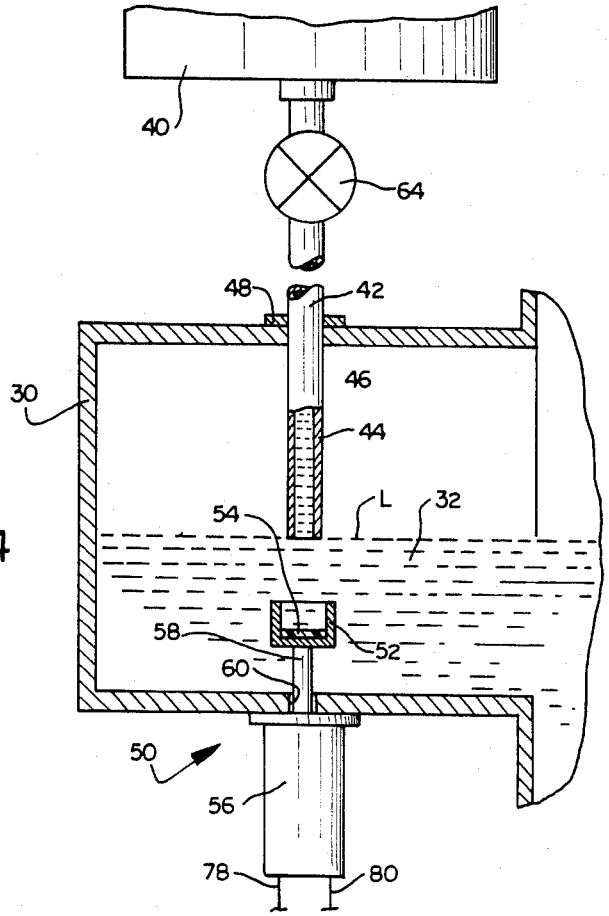
FIG. 4 is a view similar to FIG. 3 showing the oil dispenser at the completion of the oil-addition process.

Eventually, enough oil will be dispensed into the crankcase 24 so that the lower end 44 will be covered by the oil 32. Because the reservoir 40 is airtight, the covering of the lower end 44 will be sufficient to prevent more oil being dispensed into the crankcase 24. This condition is illustrated in FIG. 4. So long as the engine 20 is inoperative, the configuration shown in FIG. 4 will be maintained. Immediately upon engine start-up, however, the switch 76 will be opened and the valve 50 will be moved to the closed position shown in FIGS. 1 and 2 as described previously.

As oil gradually is consumed by the engine 20 and is dispensed from the reservoir 40, eventually it will be necessary to replenish the oil in the reservoir 40. Oil replenishment can occur while the engine 20 is running or while it is inoperative. If the engine 20 is inoperative, it is necessary to prevent oil from being dispensed into the crankcase 24 upon the release of the vacuum within the container 40 as will occur when the container closure is opened. In such a circumstance, the switch 86 is moved to the closed position shown in FIG. 1, whereby the solenoid 66 is activated and the valve element 64 is closed. Accordingly, the container 40 can be opened and oil can be added to the container 40 without any possibility that additional oil will be discharged into the crankcase 24. After the reservoir 40 has been filled and closed, the switch 86 can be opened, whereupon additional oil flow from the reservoir 40 will be possible as described previously. Oil also can be added to the reservoir 40 while the engine 20 is running. In this case, the position of the switch 86 does not have any influence on the dispensing of oil into the crankcase 24 because the valve 50 always is closed while the engine 20 is running.

An additional feature of the invention relates to the effectiveness of the seal provided by the valve 50. As shown in the Figures, the cup-like member 52 remains filled with oil under all operating conditions. Accordingly, a small pool of oil will surround the lower end 44 upon closure of the valve 50. In effect, the lower end 44 always will be immersed in oil under valve-closed conditions. The oil surrounding the lower end 44 will act as a seal preventing entry of air into the conduit 42 and the possible release of oil from the reservoir 40. Further, the valve seat 54 always will be covered by oil, thereby ensuring flexibility of the valve seat 54. In turn, the valve seat 54 should be capable of effectively sealing the lower end 44 indefinitely.

It will be appreciated from the foregoing description that the oil dispenser 10 according to the invention is exceedingly simple, effective, and reliable in operation. Although the invention has been described for use with internal combustion engines having a crankcase, it is to be understood that the invention is equally applicable to machinery of any type where a desired level of oil needs to be maintained in a crankcase or sump. Further, although the invention has been described for the dispensing of oil, it is to be understood that the invention is capable of dispensing oil of any type and, indeed, other fluids such as water or various chemicals. In view of the foregoing remarks, it is to be understood that the various components of the invention and their arrangement can be modified within the true spirit and scope of the invention as hereinafter claimed and all such modifications are within the scope of the invention. It is intended that the patent shall cover, by suitable expression in the appended claims, whatever degree of patentable novelty exists in the invention disclosed.

What is claimed is:

1. An oil dispenser for internal combustion engines having a crankcase, comprising:

an oil-containing, airtight reservoir disposed at a vertical location above the crankcase;

a conduit connecting the reservoir and the crankcase, the conduit establishing fluid communication between the reservoir and the crankcase, the conduit having a lower end disposed in the crankcase at a level at which oil is desired to be maintained in the crankcase;

a solenoid-activated valve disposed at the lower end of the conduit, the valve adapted to selectively permit or prevent the flow of oil through the conduit; and a control means connected to the solenoid-activated valve for opening the solenoid-activated valve after the engine has ceased operation and after a predetermined period of time has elapsed.

2. The oil dispenser of claim 1, further comprising:

a second solenoid-activated valve disposed in the conduit; and a manually operated switch connected in series with the second solenoid-activated valve to control activation thereof.

3. The oil dispenser of claim 1, wherein the solenoid-activated valve includes a cup-like member adapted to surround and to be fitted against the lower end of the conduit upon valve closure.

4. The oil dispenser of claim 3, further comprising an elastomeric valve seat disposed at the bottom of the cup-like member.

5. The oil dispenser of claim 1, wherein the control means comprises:

a timer in series with the solenoid-activated valve; and a manually operated switch in series with the timer.

6. The oil dispenser of claim 9, further comprising:

a second solenoid-activated valve disposed in the conduit; and a manually operated switch connected in series with the second solenoid-activated valve and the timer to control activation of the second solenoid-activated valve.

7. The oil dispenser of claim 1, further comprising:

a hollow protrusion extending outwardly of the crankcase and in fluid communication therewith, the protrusion being located at a vertical location at which oil is desired to be maintained in the crankcase; and an opening in the protrusion through which the conduit extends, the lower end of the conduit terminating at a vertical location within the protrusion.

8. The oil dispenser of claim 7, wherein the solenoid-activated valve includes a cup-like member disposed within the protrusion and adapted to surround and to be fitted against the lower end of the conduit upon valve closure.

9. The oil dispenser of claim 8, further comprising an elastomeric valve seat disposed at the bottom of the cup-like member.

10. The oil dispenser of claim 8, further comprising a second opening in the protrusion, the solenoid being disposed outside the protrusion and connected to the cup-like member by means of a shaft extending through the opening.

11. An oil dispenser for internal combustion engines having a crankcase, comprising:

an oil-containing, airtight reservoir disposed at a vertical location above the crankcase;

a hollow protrusion extending outwardly of the crankcase and in fluid communication therewith, the protrusion being located at a vertical location at which oil is desired to be maintained in the crankcase;

the conduit connecting the reservoir and the protrusion, the conduit establishing fluid communication between the reservoir and the protrusion, the conduit having a lower end disposed in the protrusion at a level at which oil is desired to be maintained in the crankcase;

a first solenoid-activated valve disposed at the lower end of the conduit, the valve adapted to selectively permit or prevent the flow of oil through the conduit, the solenoid-activated valve including a cup-like member disposed within the protrusion and adapted to surround and to be fitted against the lower end of the conduit upon valve closure, the cup-like member including an elastomeric valve seat disposed at its bottom;

an opening in the protrusion, the solenoid of the first solenoid-activated valve being disposed outside the protrusion and connected to the cup-like member by means of a shaft extending through the opening in the protrusion;

a second solenoid-activated valve disposed in the conduit;

a manually operated switch connected in series with the second solenoid-activated valve to control activation thereof; and a control means connected to the first and second solenoid-activated valves for opening the first solenoid-activated valve after the engine has ceased operation and after a predetermined period of time has passed, the control means including a timer in series with the first solenoid-activated valve and a manually operated switch in series with the timer and the second solenoid-activated valve.

* * * * *

UNITED STATES PATENT AND TRADEMARK OFFICE

CERTIFICATE OF CORRECTION

PATENT NO. : 4,724,926

DATED : February 16, 1988

INVENTOR(S) : Lonnie L. Collins

It is certified that error appears in the above-identified patent and that said Letters Patent are hereby corrected as shown below:

Column 2, line 54 -- "additing" should be "adding"

Column 6, line 18 -- "9" should be "5"

Signed and Sealed this

Twelfth Day of July, 1988

*Attest:*

DONALD J. QUIGG

*Attesting Officer*

*Commissioner of Patents and Trademarks*